US005735789A

United States Patent [19]

Borgstrom et al.

[11] Patent Number: 5,735,789

[45] Date of Patent: Apr. 7, 1998

[54] CENTRIFUGAL SEPARATOR

[75] Inventors: Leonard Borgstrom, Tyresö; Patrik Brehmer, Taby; Claes-Goran Carlsson; Peter Franzen, both of Tullinge; Claes Inge, Saltsjo-Duvnas; Torgny Lagerstedt; Hans Moberg, both of Stockholm, all of Sweden

[73] Assignee: Alfa Laval Separation AB, Tumba, Sweden

[21] Appl. No.: 498,947

[22] Filed: Jul. 6, 1995

Related U.S. Application Data

[63] Continuation-in-part of Ser. No. 190,079, filed as PCT/SE93/00448, May 19, 1993, abandoned.

[30] Foreign Application Priority Data

Jun. 16, 1992 [SE] Sweden ..... 9201838

[51] Int. Cl.[6] ..... B04B 1/08

[52] U.S. Cl. ..... 494/70

[58] Field of Search ..... 494/67–71, 73

[56] References Cited

U.S. PATENT DOCUMENTS 902,913 11/1908 Risberg ..... 494/70

FOREIGN PATENT DOCUMENTS 392129 3/1924 Germany ..... 494/70

1261715 10/1986 U.S.S.R. ..... 494/67

*Primary Examiner*—Terrence Till

*Attorney, Agent, or Firm*—Fish & Richardson P.C.

[57] ABSTRACT

A centrifugal separator to clean a liquid from a substance having a lower density than the liquid comprises a rotor forming a separation chamber (6), in which a stack of conical separation discs (15) is arranged. Liquid and substance dispersed therein flow radially outwards in interspaces between the discs. To increase the separation capability upon a high flow through the separator, the separation discs (15) have a radial inner zone (29*a*), which has no obstacles for primary flow in the circumferential direction and a radial outer zone (28*a*), which has so many equally around the rotational axis distributed elongated and through the outer zone (28*a*) extending obstacles (27*a*) for liquid flow in circumferential direction that the primary flow in this zone (28*a*) takes place radially outwards between the obstacles (27*a*). The obstacles (27*a*) have such a length and such a direction in relation to the primary flow that the liquid flow in a layer closest to a layer of substance so influences the layer of substance that separated substance is accumulated on and flows radially inwards along the flow obstacle (27*a*) ahead.

14 Claims, 2 Drawing Sheets

CENTRIFUGAL SEPARATOR

This application is a continuation-in-part of our application Ser. No. 08/190,079 filed Feb. 1, 1994 now abandoned, which corresponds to PCT/SE93/00448, May 19, 1993.

FIELD OF THE INVENTION

The present invention concerns a centrifugal separator to cleanse a liquid of a substance dispersed therein, which has lower density than the liquid. The separator comprises a rotor rotatable around a rotational axis. Inside the rotor is formed an inlet chamber, a separation chamber connected to the inlet chamber, and an outlet chamber connected to the separation chamber, for liquid which has been cleaned of the substance. In the separation chamber a stack of several frusto-conical separation discs is arranged coaxially with the rotational axis. The separation discs are provided with distancing elements, which keep the discs at a distance from each other so that in pairs they form interspaces. The centrifugal separator also comprises means for conducting the liquid and the substance dispersed therein, during operation, from the inlet chamber to a central part of the disc interspaces in a way such that liquid flows radially outwardly in the interspaces.

BACKGROUND OF THE INVENTION

Centrifugal separators of the kind described have been known for a long time. The liquid mixture to be centrifugally treated is normally conducted into the interspaces via supply holes centrally located in the separation discs. The distancing elements generally consist of spot-like elements or of distancing elements extending radially between the separation discs. Spot-like elements have essentially no influence on the flow in the interspaces. Thus, the geostrophic flow, which is created upon a so-called geostrophic balance in the interspaces, will be directed essentially in the circumferential direction, and the radially outwardly directed flow of liquid will take place in thin so-called Ekman-layers along the upper and underside of the separation discs.

The radial flow resistance in these interspaces becomes high, which results in the flow being equally distributed between the different interspaces. In addition, the minor flow resistance in the circumferential direction means that the flow in each interspace becomes equally distributed in the circumferential direction.

However, the fact that the radially outwardly directed flow of liquid is distributed in thin Ekman-layers means that the flow velocity in these layers becomes high. This means that the layer of substance, which during operation has been separated in an interspace and accumulated on a radially outwardly directed side of a separation disc, which is generally its upper side, is exposed to a heavy shearing force, which strives to bring the substance radially outwards. If this shearing force exceeds the centrifugal force, which strives to bring the layer of substance radially outwardly, there is a risk of having the substance entrained in the flow of the liquid, and removed from the centrifugal separator with the liquid. This limits the possibility of getting the liquid clean of the substance.

Centrifugal separators of this kind are, for instance, used in a marine context, to clean water which is polluted by oil. Until now, only at low flow rates has it been possible to achieve a sufficiently good separation result to discharge the cleaned water directly into the sea.

SUMMARY OF THE INVENTION

The object of the present invention is to provide a centrifugal separator of the kind initially described, which has a satisfactory capability of separation at a higher flow capacity than hitherto known centrifugal separators, when used to separate a liquid from a substance dispersed in the liquid, which has a lower density than the liquid. The substance might consist of solid particles or fractions of another liquid having a lower density than the first mentioned liquid.

According to the invention, this object is achieved in a centrifugal separator of the kind described, by designing the separation discs with a radial inner zone, which has essentially no obstacles for a primary flow, a so-called geostrophic flow, in the circumferential direction, so that during operation radial flow of liquid and dispersed substance in this zone takes place in very thin layers, so-called Ekman-layers, along the conical surfaces of the discs. The separation discs are also designed with a radial outer zone, which connects with the radial inner zone at the radial outer portion of the inner zone, and has a large number of elongated obstacles to circumferential flow equally distributed around the rotational axis, and radially through the radial outer zone. The number of such obstacles is selected so that primary flow in the radial outer zone takes place essentially radially outwardly between adjacent flow obstacles. The obstacles have a length and orientation relative to the rotational direction so that a secondary flow, caused by the primary flow in the outer zone, in a so-called Ekman-layer, on a radially outwardly directed surface of a separation disc influences the layer of substance separated on this surface with a shearing force in a direction towards an adjacent flow obstacle lying ahead in the rotational direction, so that separated substance is accumulated at and flows radially inwardly along the adjacent flow obstacle, in the direction of rotation.

To achieve this effect, the obstacles are preferably at least as long as the maximum distance between obstacles. The obstacle-free inner zone is at least one-half the total length of the conical wall and the number of obstacles is such that the angular distance between obstacles is equal to or less than about 30°, preferably equal to or less than about 20° and usually about 15°. Thus, the number of obstacles is at least 12, preferably at least 18 (as shown in FIGS. 2 and 3) and usually about 24. There is no absolute upper limit on the number of obstacles, but normally as few are used as is necessary to obtain the desired effect, since increasing the number increases the cost of the equipment and reduces the useful separation area between obstacles.

By designing a centrifugal separator in this way the flow through each interspace becomes equally distributed in the circumferential direction and a resistance to flow radially outwardly through the interspaces is obtained which is great enough to obtain an equal distribution of the flow over the different interspaces in the stack. At the same time the radially outwardly directed flow of liquid is changed from taking place in thin Ekman-layers in the radial inner zone to taking place in an essentially thicker layer of primary flow in the radial outer zone. Primary flow in the circumferential direction ceases almost completely when the liquid flow through the interspaces exceeds a certain value. Thus, the flow velocity of the liquid in the radially outer zone becomes lower, which in turn means that the layer of substance, which has been accumulated on the radially outwards directed side of the separation discs in the outer zone, is influenced by a lower radially outwardly directed shearing force from the liquid flow. It is especially important in this, the radially outer zone, to keep these shearing forces low, since the layers of substance in this zone are thin and therefore the centrifugal force acting radially outwardly on the layer of substance is small.

One object of the obstacles in a separator according to the invention is to create lee-zones, i.e. sheltered zones on the leeward sides of the obstacles where the lighter substance can be accumulated without being exposed to shear forces by countercurrent (with respect to the direction of rotation) liquid flows. At the tips of the obstacles vortices are gradually created and are entrained by the liquid. These vortices form a protective barrier for the lee zones formed in the obstacle interspaces. The size of the lee zone depends on the distance the vortices are carried before they degenerate and disappear. The greater the liquid flow rate, the greater the desirability of establishing lee-zones and fortunately the larger the lee-zones become. Desirably, the lee-zone extends all the way to the next obstacle.

In a preferred embodiment it is suggested, for economy of manufacture, that the flow obstacles in the radial outer zone be straight and directed essentially radially.

In a special embodiment the flow obstacles are curved forward in the rotational direction seen radially outwardly. By this means, the primary flow is directed forwardly in the rotational direction. Since the shearing force, with which the primary flow influences the layer of substance, is directed 45° to the right seen in the direction of primary flow, the shearing force is directed so that it counteracts the centrifugal force less, whereby the separation result is improved.

In a special embodiment the radial inner zone is annular and surrounds the rotational axis. However, it is quite possible within the scope of the present invention to design a separation disc with a radial inner zone which does not surround the rotational axis. A small number of the flow obstacles arranged in the outer zone might, for instance, extend radially inwardly to a central part of the separation disc and limit the radial inner zone in the circumferential direction. In this case, the radial inner zone will only include a section of the separation disc. However, this sector should have an angle at the center, which at least is 45°, preferably at least 60°, to create a sufficient primary flow, a geostrophic flow, in circumferential direction in this zone.

In still another embodiment the separation discs are designed with centrally located supply holes in order to have the supplied liquid mixture not entrain and mix with already separated and substance centrally accumulated in the separation chamber.

BRIEF DESCRIPTION OF THE DRAWINGS

The invention will be further described with reference to the accompanying drawings, in which.

DETAILED DESCRIPTION OF THE PREFERRED EMBODIMENTS

Figure 1:
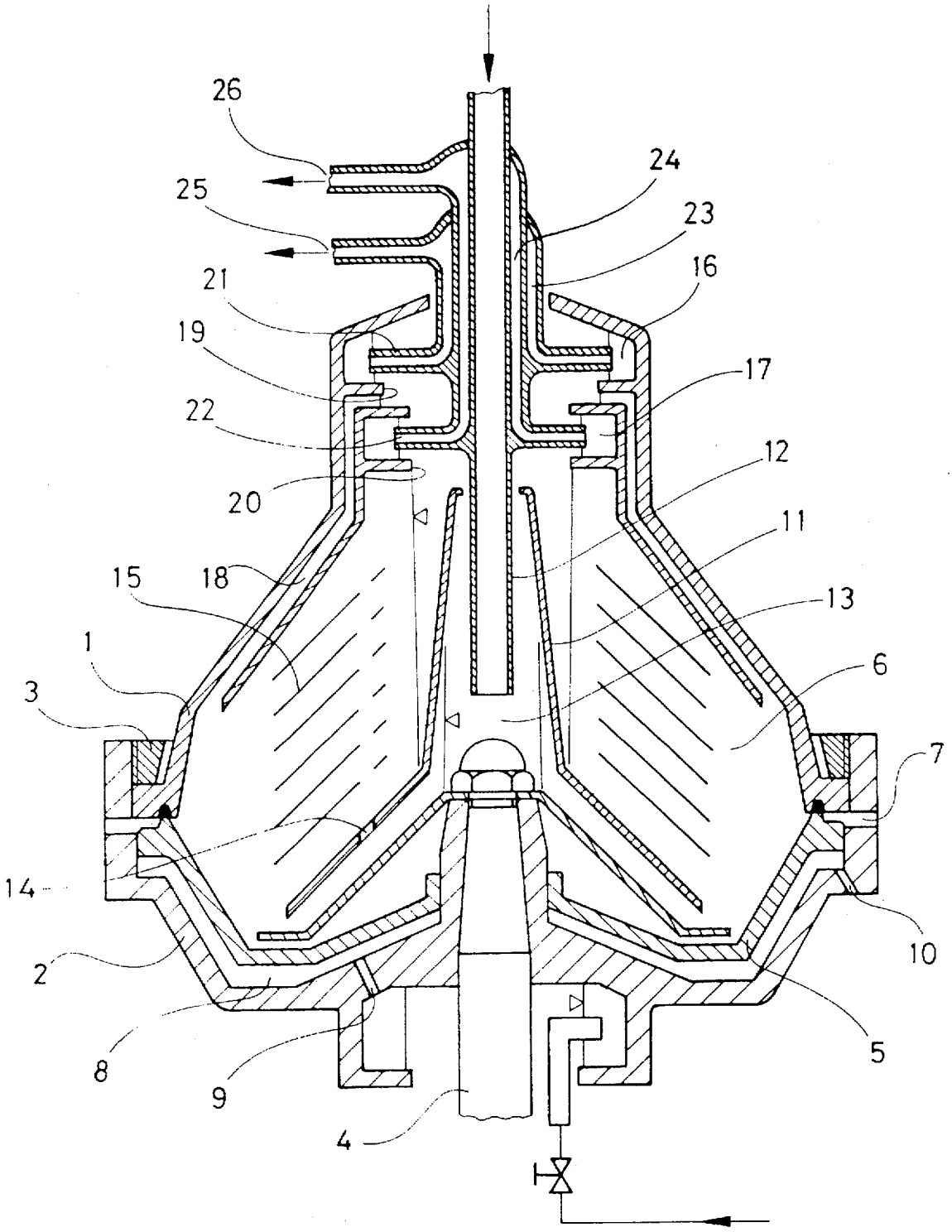
FIG. 1 schematically shows an axial section through a rotor in a centrifugal separator according to the invention.

The rotor shown in FIG. 1 comprises an upper part 1 and a lower part 2, which parts are kept together by a locking ring 3. The rotor is supported by a driving shaft 4, which is connected to the lower part 2. Inside the rotor there is a valve slide 5 arranged axially movable in the lower part 2. The valve slide 5 forms together with the upper part 1 a separation chamber 6 and is arranged to open and close an annular gap at the largest periphery of the separation chamber 6 between the separation chamber 6 and the outlet openings 7 to let out intermittently a component, which during operation has been separated out of a liquid mixture supplied to the rotor and accumulated at the periphery of the separation chamber 6. The valve slide 5 together with the lower part 2 defines a closing chamber 8, which is provided with an inlet 9 and a throttled outlet 10 for a closing liquid.

A distributor 11 is arranged centrally in the rotor. It surrounds a stationary inlet tube 12 and within itself forms an inlet chamber 13. The inlet chamber 13 is connected to the separation chamber 6 via relatively centrally located holes 14 in the conical lower part of the distributor 11. Inside the separation chamber 6 a stack of a number of frusto-conical separation discs 15 is arranged coaxially with the rotational axis. The stack is supported by and guided by the distributor 11. At least a part of the separation discs 15 are identical.

In the figure shown, at its upper end, the upper part 1 forms a central outlet chamber 16 for the discharge of cleaned liquid and a central outlet chamber 17 for the discharge of substance separated during operation. The first mentioned outlet chamber 16 communicates with the separation chamber 6 via an outlet channel 18 formed in the upper part 1 and an overflow outlet 19. The channel 18 formed in the upper part 1 opens in a radially outer portion of the separation chamber 6. The outlet chamber 17 communicates via an overflow outlet 20 with a central part of the separation chamber 6.

In the two outlet chambers 16 and 17 a stationary discharge device 21, 22, respectively, is arranged in a known manner to discharge liquid and substance, respectively, through internal outlet channels 23, 24, respectively, towards an outlet 25, 26, respectively.

Figure 2:
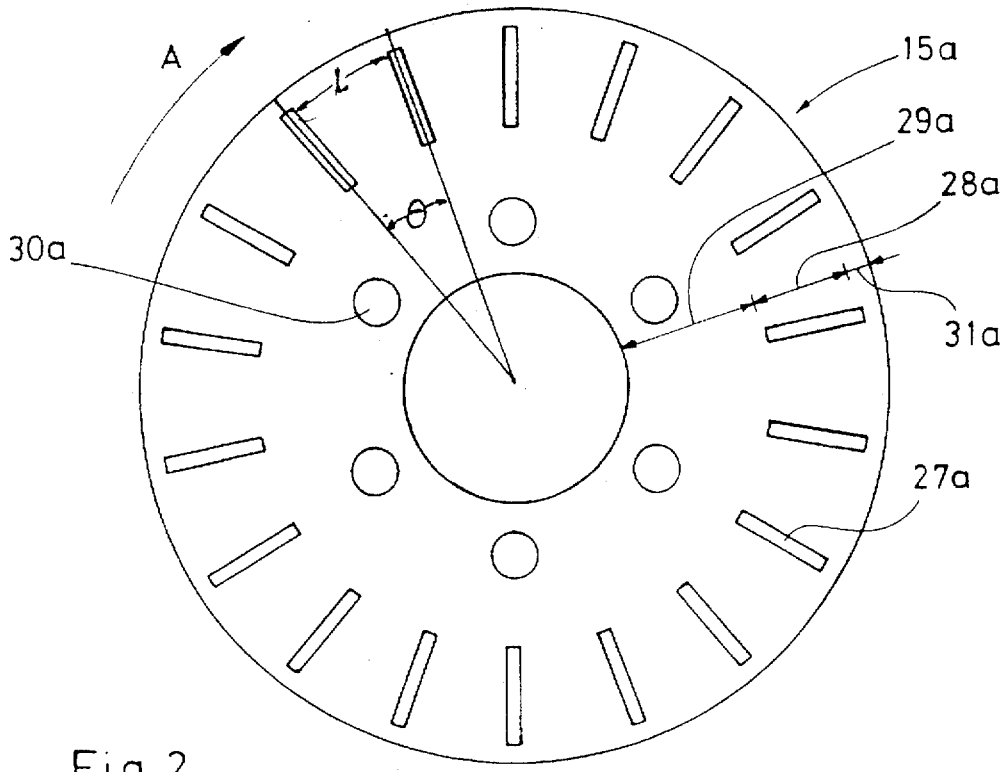
FIG. 2 shows a separation disc in a centrifugal separator according to FIG. 1 seen from above.

FIG. 2 shows a separation disc 15*a* seen from above. An arrow A shows the rotational direction during operation of the rotor and thereby the rotational direction during operation of the separation disc.

On its upper side the frusto-conical separation disc 15*a* has several straight elongated flow obstacles 27*a* to the liquid flow in the circumferential direction, which obstacles are equally distributed around the center of the separation disc and are separated from each other by an angle θ which is less than 30°, preferably less than 20° and typically about 15°. The obstacles are at least as long as the maximum distance, L, between obstacles. They extend radially through a radially outer zone 28*a* of the separation disc 15*a*. The flow obstacles 27*a* constitute at the same time distancing elements, which keep the separation discs at a distance from each other in the stack in a way such that pairs of discs form an interspace. Other distancing means such as cylindrical studs may, of course, be used, i.e. it is not necessary that the obstacles serve also as distancing means. Radially inside the outer zone 28*a*, the frusto-conical separation disc is designed with a radially inner zone 29*a*, which has no obstacles for the liquid flow in the circumferential direction along its conical surface and from the inner radius of the separation disc extends radially outwardly towards the inner portion of the radial outer zone 28*a*. The inner zone 29*a* is at least one half of the total width of the disc, i.e. in FIG. 2 one half of 29*a*, 28*a* and 31*a*. In a radial inner part of the radial inner zone 29*a*, a number of supply holes 30*a* are arranged equally distributed around the center of the separation disc 15*a* for the supply of liquid to be treated.

Figure 3:
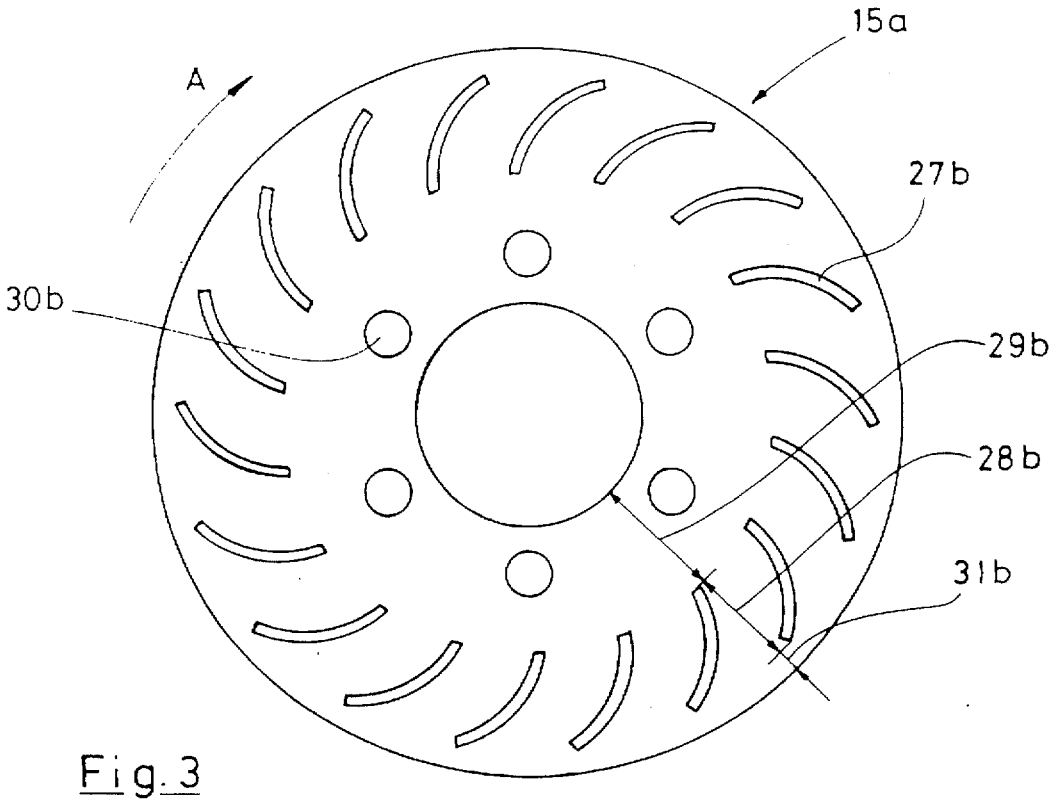
FIG. 3 shows another embodiment of a separation disc in a centrifugal separator according to FIG. 1 seen from above.

FIG. 3 shows another embodiment of a separation disc 15*b* seen from above. As in FIG. 2 an arrow A shows the rotational direction during operation of the rotor and the separation disc.

On its upper side the frusto-conical separation disc 15b shown in FIG. 3 has several curved elongated flow obstacles 27b for liquid flow in the circumferential direction, which are equally distributed around the center of the separation disc and extend radially through the radial outer zone 28b of the separation disc 15b. Seen radially outwardly the flow obstacles are curved forward in the rotational direction. As the flow obstacles 27a on the separation disc 15a according to FIG. 2 the flow obstacles 27b on the separation disc 15b according to this embodiment also constitute distancing elements. Also this embodiment has a radial inner zone 29b, which has no obstacles for the flow in the circumferential direction and extends from the inner radius of the separation disc radially outwards towards the radial inner portion of the radial outer zone 28b. A number of supply holes 30b are also in this separation disc 15b equally distributed around the center of the separation disc 15b and a radial inner portion of the radial inner zone 29b. The number and size of the curved obstacles of FIG. 3 are in general the same as in the embodiment of FIG. 2.

Both the separation discs according to FIG. 2 and the separation disc according to FIG. 3 are provided with a further zone 31a, 31b, respectively, located radially outside the flow obstacles in the outer zone 28a, 28b, respectively. As with the radial inner zone 29a, 29b, respectively, this surrounds the rotational axis and has no obstacles for liquid flow in the circumferential direction. The arrangement of such a further zone 31a, 31b, respectively, means that the distribution of flows etc. is equalized in the circumferential direction in the radial outer portion of the separation chamber 6.

A centrifugal separator designed according to the invention works in the following manner:

When starting the centrifugal separator the rotor is brought to rotate and the separation chamber 6 is closed by supplying closing liquid to the closing chamber 8 through the inlet 9. Then the liquid with a substance dispersed therein to be centrifugally treated can be supplied to the separation chamber 6 via the inlet tube 12, the inlet chamber 13 and the supply hole 14 in the distributor 11. The supply liquid is distributed via the supply holes 30a or 30b out into the interspaces between the separation discs 15 where the substantial separation takes place. During the separation the specific heavier liquid flows radially outwardly and is accumulated at the radial outer portion of the separation chamber, whereas the specific lighter substance is accumulated on the radial outwardly directed sides of the separation discs 15 and flows along these radially inwardly.

The cleaned liquid flows out of the separation chamber 6 through the channel 18 and via the overflow outlet 19 into the outlet chamber 16. The liquid is discharged out of the outer chamber 16 through internal discharge channels 27 in a stationary discharge device 21 out towards an outlet 25.

The separated substance accumulated in the central portion of the separation chamber 6 flows out of the separation chamber 6 via an overflow outlet 20 into the outlet chamber 17. Also the substance is discharged out of the outlet chamber 17 through internal channels 24 in a stationary outer device 22 towards an outlet 26.

If specific heavier solid particles, sludge or the like, are accumulated during operation at the greatest radius of the separation chamber these can be discharged intermittently during operation through the opening 7 by interrupting the supply of closing liquid to the closing chamber 8 for a short period of time.

During the flow of the liquid and the dispersed substance in the interspaces in the radial inner zone 29a, 29b, respectively, a so-called geostrophic balance is established, at which a Coriolis-force acting on the liquid is created which is as great as a counter-directed, radially inwardly directed force which the pressure gradient gives rise to. When this balance obtains most of the liquid flows in a primary flow, a so-called geostrophic flow, perpendicular to the pressure gradient. Since there are no obstacles for the liquid flow in the circumferential direction in this radial inner zone the primary flow essentially will be directed in the circumferential direction against the rotational direction.

As a result of the primary flow in the rotating system another liquid flow, a secondary flow, will be generated in thin layers on the upper and lower sides of the separation discs, so-called Ekman-layers. In these layers liquid flows in directions other than the directions of the primary flow. The direction varies with the distance from the surface of the separation disc. Closest to such a surface the flow direction in an Ekman-layer forms an angle of 45° to the direction of the primary flow. The flow direction in the Ekman-layers in the inner zone becomes a radially outwardly directed component. Thus, the radial liquid transport in this zone will take place in these thin layers. This means that the resistance for radial liquid flow through this zone is so high that the flow is distributed equally over the interspaces in the stack.

The layer of substance accumulated on the radially outwardly directed upper side of the separation discs is partly influenced by the centrifugal force, which strives to bring the layer of substance in a desired direction inwardly, partly via shearing force from the liquid flow in the Ekman-layers, which has a radially outwardly directed component.

The centrifugal force increases by increasing thickness of the layer of substance. However, the shearing force is often independent of the thickness of the layer.

In the radial outer zone 28a or 28b the primary flow is directed essentially in radial direction, whereby the liquid transport radially outwardly takes place in a substantially thicker layer than the Ekman-layer, which means that the flow velocity of the liquid and the dispersed substance therein not yet separated becomes lower. This means in turn that the shearing force acting on the layer of substance becomes lower in the radial outer zone 28a or 28b.

Since the layer of substance is thin in the radial outer zone, it is exceptionally advantageous to keep the shearing force low in this zone.

If the flow obstacles 27a or 27b are designed at least as long as the greatest distance between two adjacent flow obstacles, the fact that the shearing force forms an angle to the primary flow, which is 45° means that the substance to a great extent will be accumulated on a rear side of the next flow obstacle in the direction of rotation and flow radially inwardly along the same.

If the flow obstacles 27b are curved forwardly in the rotational direction seen radially outwards, as shown in FIG. 3, the shearing force does not counteract the centrifugal force to the same extent but the resulting force gives a direction more favorable for the separation result.

What is claimed is:

1. A centrifugal separator for cleaning a liquid of a substance dispersed therein, which substance has a lower density than the liquid, comprising a rotor rotatable around a rotational axis, the rotor comprising an inlet chamber, a separation chamber, means connecting said separation chamber to said inlet chamber, an outlet chamber for liquid which is cleansed of the substance, means connecting said outlet chamber to said separation chamber, a stack of several frusto-conical separation discs, each having an inner edge and an outer edge, arranged in the separation chamber coaxial with the rotational axis, said discs being maintained at a distance from each other so that an interspace is formed between each disc and its adjacent discs, and means, including an aperture in each of said discs, for conducting said liquid and the substance dispersed therein from the inlet chamber to a central part of said interspaces, so that the liquid flows radially outwardly in said interspaces, said apertures being located radially outwardly from the inner edge of said discs to leave a space on said discs between said apertures and said inner edges, said interspaces having a radial inner zone, which is free from obstacles to a primary geostrophic flow in the circumferential direction, radial flow of liquid and of dispersed substance in this zone during operation of the device occurring in very thin Ekman-layers, along the conical surfaces of the discs, said apertures being located in said inner zone, said interspaces having radial outer zones which connect with the radial inner zones at the radially outer portions of said inner zones and having a multiplicity of elongated obstacles to liquid flow in the circumferential direction extending radially through the outer zone and equally distributed around the rotational axis to cause primary flow in the radial outer zone to take place essentially radially outwardly between adjacent obstacles, said obstacles having a length and an orientation in relation to the rotational direction such that a secondary flow, caused by the primary flow in the outer zone in an Ekman-layer on a radially outwardly directed surface of a separation disc, influences a layer of substance separated on said surface with a shearing force in a direction toward the flow obstacle which is immediately adjacent in the direction or rotation, so that separated substance is accumulated at said flow obstacle and flows radially inwardly along the flow obstacle.

2. A centrifugal separator according to claim 1, wherein said flow obstacles in the radial outer zone are straight.

3. A centrifugal separator according to claim 2, wherein said flow obstacles in the radial outer zone are directed essentially radially.

4. A centrifugal separator according to claim 1, wherein the flow obstacles extend radially at least as long as the greatest distance in the circumferential direction between two adjacent flow obstacles.

5. A centrifugal separator according to claim 1, wherein the angular separation between obstacles is at most about 30°.

6. A centrifugal separator according to claim 5 wherein the angular separation between obstacles is at most about 20°.

7. A centrifugal separator according to claim 6 wherein the angular separation between obstacles is about 15°.

8. A centrifugal separator according to claim 1, wherein said flow obstacles in the radial outer zone are curved forward in the rotational direction seen radially outwards.

9. A centrifugal separator according to claim 1, wherein the radial inner zone is annular and surrounds the rotational axis.

10. A centrifugal separator according to claim 9 wherein the radial inner zone is at least one half the total width of the disc.

11. A centrifugal separator according to claim 1, wherein said flow obstacles are said distancing elements.

12. A centrifugal separator for cleaning a liquid of a substance dispersed therein, which substance has a lower density than the liquid, comprising a rotor rotatable around a rotational axis, the rotor comprising an inlet chamber, a separation chamber, means connecting said separation chamber to said inlet chamber, a first outlet chamber for liquid which is cleansed of the substance, a second outlet chamber for separated substance, means connecting said first outlet chamber to said separation chamber, a stack of several frusto-conical separation discs arranged in the separation chamber coaxial with the rotational axis, said discs being maintained at a distance from each other so that an interspace is formed between each disc and its adjacent discs and means for conducting said liquid and the substance dispersed therein from the inlet chamber to a central part of said interspaces, so that the liquid flows radially outwardly in said interspaces, said interspaces having a radial inner zone, which is free from obstacles to a primary geostrophic flow in the circumferential direction, radial flow of liquid and of dispersed substance in this zone during operation of the device occurring in very thin Ekman-layers, along the conical surfaces of the discs, said interspaces having radial outer zones which connect with the radial inner zones at the radially outer portions of said inner zones and having a multiplicity of elongated obstacles to liquid flow in the circumferential direction extending radially through the outer zone and equally distributed around the rotational axis to cause primary flow in the radial outer zone to take place essentially radially outwardly between adjacent obstacles, said obstacles having a length and an orientation in relation to the rotational direction such that a secondary flow, caused by the primary flow in the outer zone in an Ekman-layer on a radially outwardly directed surface of a separation disc, influences a layer of substance separated on said surface with a shearing force in a direction toward the flow obstacle which is immediately adjacent in the direction of rotation, so that separated substance is accumulated at said flow obstacle and flows radially inwardly along the flow obstacle, and a passageway extending from a surface of each of said discs at the radially inner end of each of said obstacles to enable said accumulated separated substance to pass from each of said interspaces to said second outlet chamber, at least a portion of said passageway being in said radial inner zone.

13. A centrifugal separator according to claim 12, wherein said means connecting said separation chamber to said inlet chamber consists of centrally located inlet holes in the separation discs.

14. A centrifugal separator for cleaning a liquid of a substance dispersed therein, which substance has a lower density than the liquid, comprising a rotor rotatable around a rotational axis, the rotor comprising an inlet chamber, a separation chamber, means connecting said separation chamber to said inlet chamber, a first outlet chamber for liquid which is cleansed of the substance, a second outlet chamber for separated substance, means connecting said first outlet chamber to said separation chamber, a stack of several frusto-conical separation discs, each having an inner edge and an outer edge, arranged in the separation chamber coaxial with the rotational axis, said discs being maintained at a distance from each other so that an interspace is formed between each disc and its adjacent discs and means, including an aperture in each of said discs, for conducting said liquid and the substance dispersed therein from the inlet chamber to a central part of said interspaces, so that the liquid flows radially outwardly in said interspaces, said apertures being located radially outwardly from the inner edge of said discs to leave a space on said discs between said apertures and said inner edges, said interspaces having a radial inner zone, which is free from obstacles to a primary geostrophic flow in the circumferential direction, radial flow of liquid and of dispersed substance in this zone during operation of the device occurring in very thin Ekman-layers, along the conical surfaces of the discs, said apertures being located in said inner zone, said interspaces having radial outer zones which connect with the radial inner zones at the radially outer portions of said inner zones and having a multiplicity of elongated obstacles to liquid flow in the circumferential direction extending radially through the outer zone and equally distributed around the rotational axis to cause primary flow in the radial outer zone to take place essentially radially outwardly between adjacent obstacles, said obstacles having a length and an orientation in relation to the rotational direction such that a secondary flow, caused by the primary flow in the outer zone in an Ekman-layer on a radially outwardly directed surface of a separation disc, influences a layer of substance separated on said surface with a shearing force in a direction toward the flow obstacle which is immediately adjacent in the direction of rotation, so that separated substance is accumulated at said flow obstacle and flows radially inwardly along the flow obstacle, and a passageway extending from a surface of each of said discs at the radially inner end of each of said obstacles to enable said accumulated separated substance to pass from each of said interspaces to said second outlet chamber, at least a portion of said passageway being in said radial inner zone.

* * * * *